US005566994A

United States Patent [19]

Mader

[11] Patent Number: 5,566,994

[45] Date of Patent: Oct. 22, 1996

[54] BREAKAWAY LEVER WITH RESET MECHANISM

[75] Inventor: Gerald E. Mader, Indianapolis, Ind.

[73] Assignee: Von Duprin, Inc., Indianapolis, Ind.

[21] Appl. No.: 509,272

[22] Filed: Jul. 31, 1995

Related U.S. Application Data

[62] Division of Ser. No. 173,883, Dec. 27, 1993, Pat. No. 5,520,427.

[51] Int. Cl.[6] ..... E05B 3/00

[52] U.S. Cl. ..... 292/336.3; 292/DIG. 26; 70/422

[58] Field of Search ..... 70/149, 222, 422, 70/223; 292/34–37, 42, 336.3, DIG. 26, DIG. 27

[56] References Cited

U.S. PATENT DOCUMENTS

| | | | |
|---|---|---|---|
| 1,565,754 | 12/1925 | Orth | 70/422 |
| 1,899,997 | 3/1933 | Sullivan | 70/222 |
| 3,314,708 | 4/1967 | Welch | 292/336.3 |
| 3,910,613 | 10/1975 | Nolin | 292/34 |
| 4,679,420 | 7/1987 | Yang | 70/222 |
| 4,773,240 | 9/1988 | Foshee | 70/222 |
| 4,920,773 | 5/1990 | Surko | 70/224 |
| 5,010,755 | 4/1991 | Best | 70/422 |
| 5,024,472 | 6/1991 | Cohrs | 292/182 |
| 5,040,652 | 8/1991 | Fish | 70/422 |
| 5,437,484 | 8/1995 | Yamada | 292/36 |

*Primary Examiner*—Lloyd A. Gall
*Assistant Examiner*—Gary Estremsky
*Attorney, Agent, or Firm*—Robert F. Palermo; A. James Richardson

[57] ABSTRACT

A door lever assembly having a locked and an unlocked position includes a trim housing and a lever handle and cam rotatably connected to the trim housing. A rotatable shaft extends between the lever handle and the cam, with the shaft defining a connection groove therethrough to provide access to a shaft interior. The shaft interior is configured to a accept a pin for connecting the cam and the shaft. This pin can be resettably disconnected following controlled slippage of frictional contact surfaces in response to excessive force applied to rotate the cam.

7 Claims, 11 Drawing Sheets

BREAKAWAY LEVER WITH RESET MECHANISM

This is a Division of application Ser. No. 08/173,883 filed Dec. 27, 1993, now U.S. Pat. No. 5,520,427.

BACKGROUND OF THE INVENTION

The present invention relates to a door lever assembly that resists vandalism and breakage. More specifically, the present invention relates to single or double door lever assembly having a breakaway door handle rotatably connected to a cam propelled slider for operating a door latch, and a key cylinder lock mechanism for blocking operation of the slider.

Conventional door levers having a fixed lock position are subject to damage by vandals or those seeking unauthorized entry into commercial or public buildings. A locked door lever extending outward in a substantially horizontal position can be impacted with hammers or other devices to break the lever or shatter lock components. In addition, it is sometimes possible to use the weight of a person seeking entry to downwardly force a door lever and break the lock mechanism.. To partially overcome this problem, certain door levers are designed to have shear pins or other elements for designed failure that break and render the lever mechanism inoperable after application of undue force.

For example, a conventional door lever typically has a trim housing configured to accommodate a key cylinder lock above a rotatable lever handle that is operably connected to a door latch mechanism. The lever handle is permanently pinned to a shaft that extends inward to engage an eccentrically configured cam. The cam can be rotated to upwardly move a slider plate that is in turn connected to a lift arm. Movement of the lift arm in turn causes movement of vertically directed rods that are connected to retract a door latch. Locking this assembly simply requires rotation of the key cylinder to engage a blocking slide known as a trim lock tumbler that prevents movement of the lift arm, and consequently fixes the slider, cam, shaft, and door lever in a fixed and locked position.

However, with this type of assembly the door lever handle is fixed (in its locked position) to extend horizontally outward. To prevent permanent damage to the lock mechanism, a shear pin is provided to connect cam and the shaft. Application of excessive torque forces to the lever handle causes failure of the shear pin, effectively disconnecting the lever and attached shaft from the remaining elements of the door lever assembly. Although this protects the remaining lock elements from further damage, it does require removal of the trim housing and replacement of the shear pin to restore lever function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door lever assembly having a lever handle rotatably connected to a trim housing and its attached stop plate; a cam connected by a shaft to the lever handle using a wedge mechanism which is movably positionable to connect the lever handle and the cam; the shaft configured to define a connection groove therethrough to provide access to a shaft interior, with the shaft interior being configured to accept the wedge mechanism for connecting the cam and the shaft; the wedge mechanism includes a wedge pin movably positionable to connect the lever handle and the cam when the cam is in its unlocked position, causing rotation of the cam as the lever handle is rotated; the wedge pin being configured to drop into the shaft interior, breaking connection between the cam and the shaft when excessive force is applied to the cam.

The foregoing and other aspects will become apparent from the following detailed description of the invention when considered in conjunction with the accompanying drawing figures.

DETAILED DESCRIPTION

Figure 1:
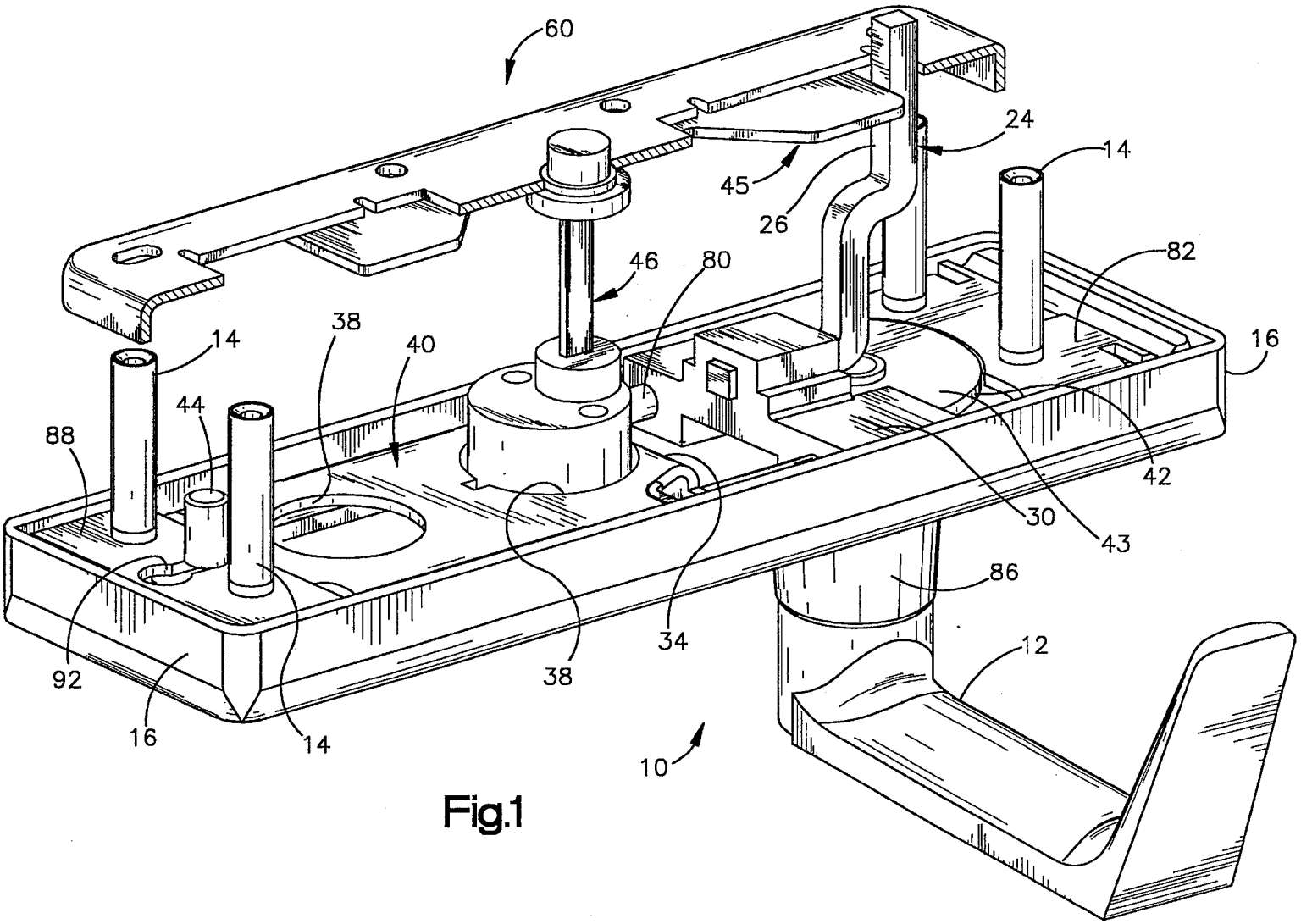
FIG. 1 is a perspective view of a door lever assembly in accordance with the present invention, showing an outwardly extending lift arm for engagement with a door latch assembly and a door lever handle in its horizontally outward extending position.

As illustrated in FIG. 1, a door lever assembly 10 for use in single or double door applications requiring breakaway lever action includes a lever handle 12 rotatably coupled by a bushing sleeve 86 to a trim housing 16. The trim housing 16 is formed from a stamped, non-machined metal, and has a pair of weld studs 44 electrically welded at opposite ends to the trim housing 16.

Figure 2:
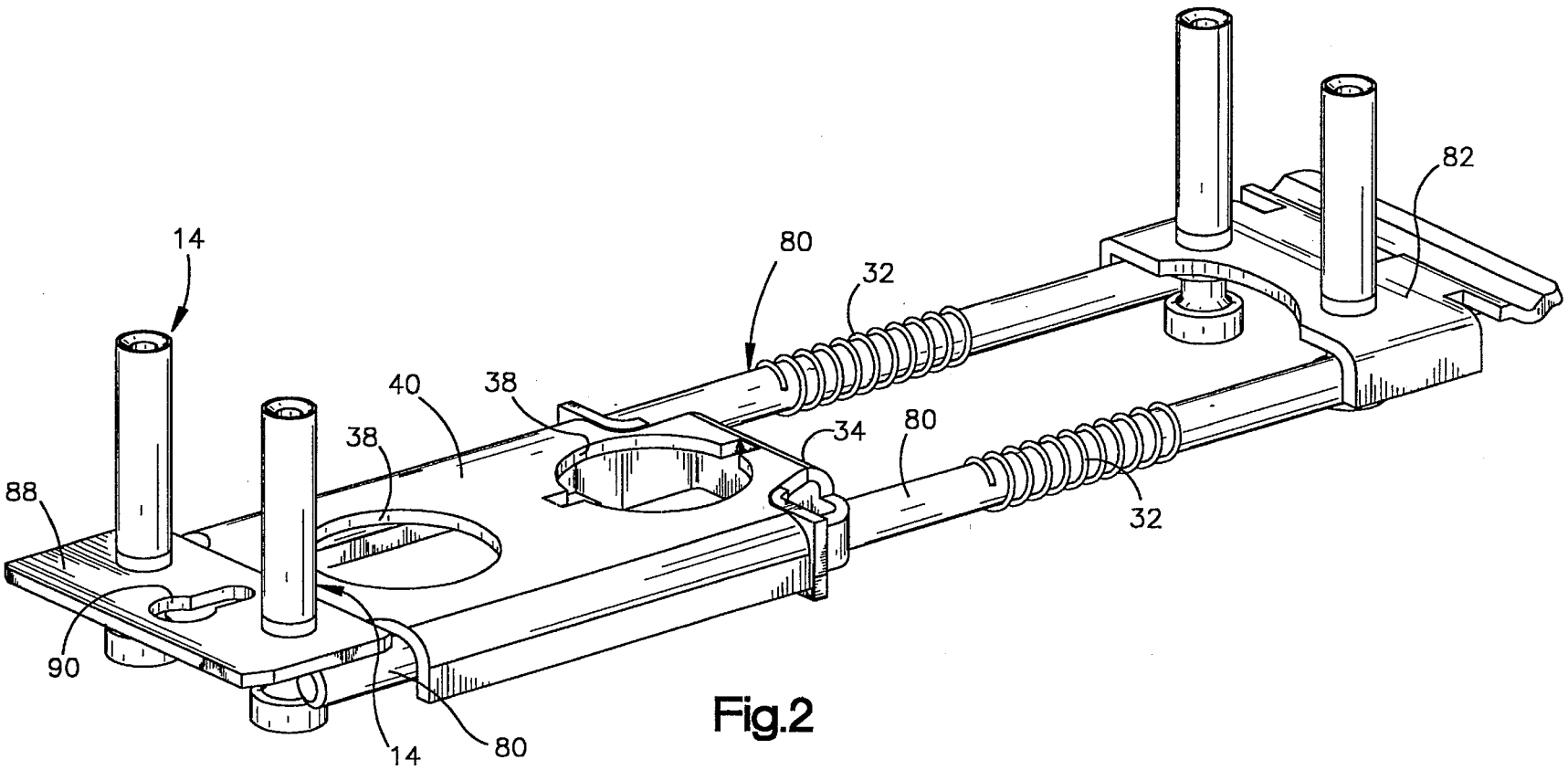
FIG. 2 is a perspective view of fixed guide rods, plates, and front and end blocks that are immovably positioned within the trim housing to support a linearly movable slide such as shown in FIG. 1.

As best seen by consideration of FIGS. 1 and 2, several components are fixed within the trim housing 16, including a pair of guide rods 80 held by a front block 88 and an end block 82. The guide rods 80 are of cylindrically shaped metal construction, and are dimensioned to snugly fit longitudinally within the trim housing 16, with each end adjacent to an edge of the trim housing 16. As will be appreciated from consideration of the Figures, the guide rods 80 retain and properly position other components of the door lever assembly 10, including a plate 40 with its door lock apertures 38 and integrally defined turned edge that forms stop plate 34.

Extending respectively through the front block 88 and end block 82 are mounting studs 14. Each mounting stud 14 engages either the front block 88 or end block 82 to hold the blocks 88 or 82 a predetermined distance apart from the trim housing 16. In addition, each mounting stud is knurled to provide a space to conformably accommodate the guide rods 80. The blocks 88 and 82 are also respectively provided with key hole slots 92 that hold the blocks in position in the trim housing by engagement with the weld studs 44.

Figure 6:
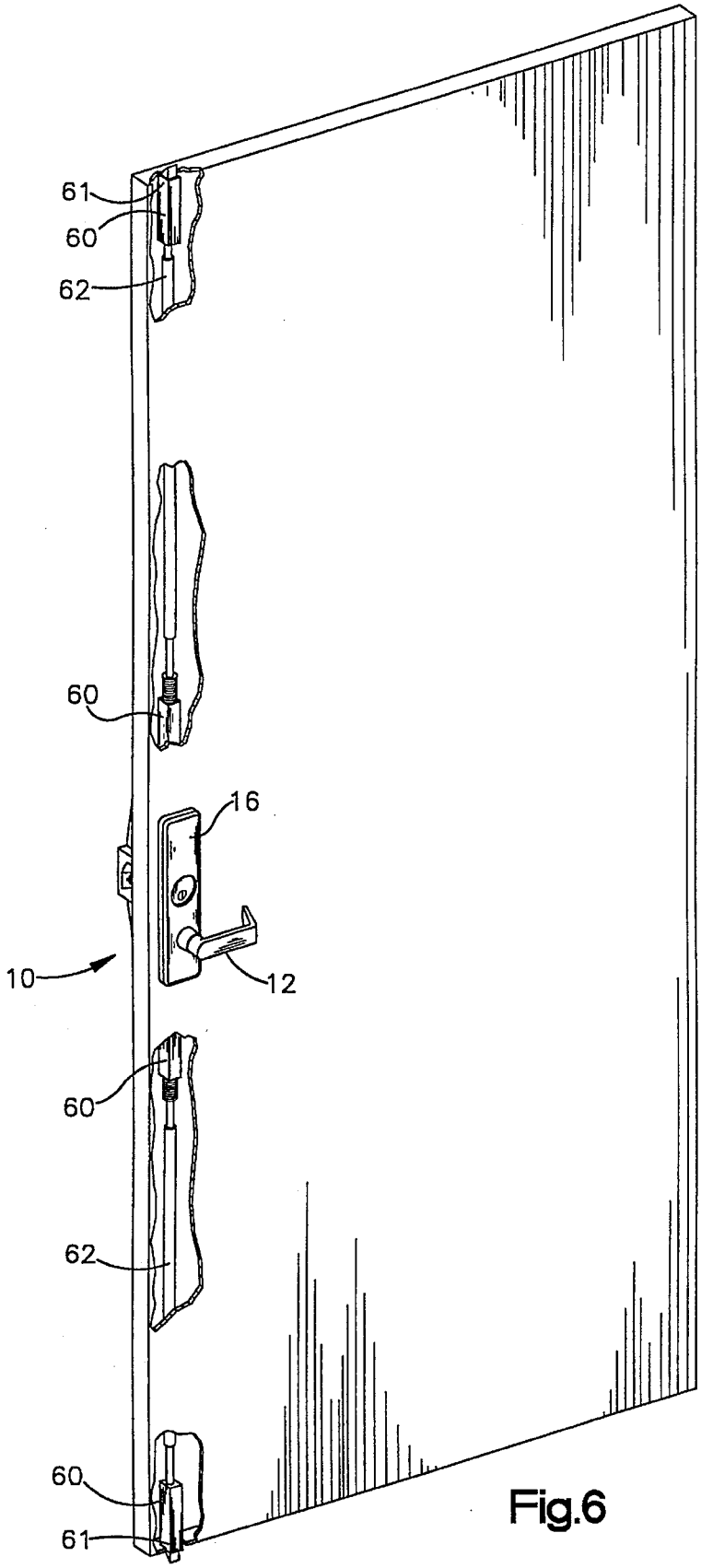
FIG. 6 is a perspective view of a door lever assembly accommodated in latchable door, with the door partially broken away to indicate vertically extending rods in the door that are movable in response to rotation of the unlocked door lever assembly.
Figure 7:
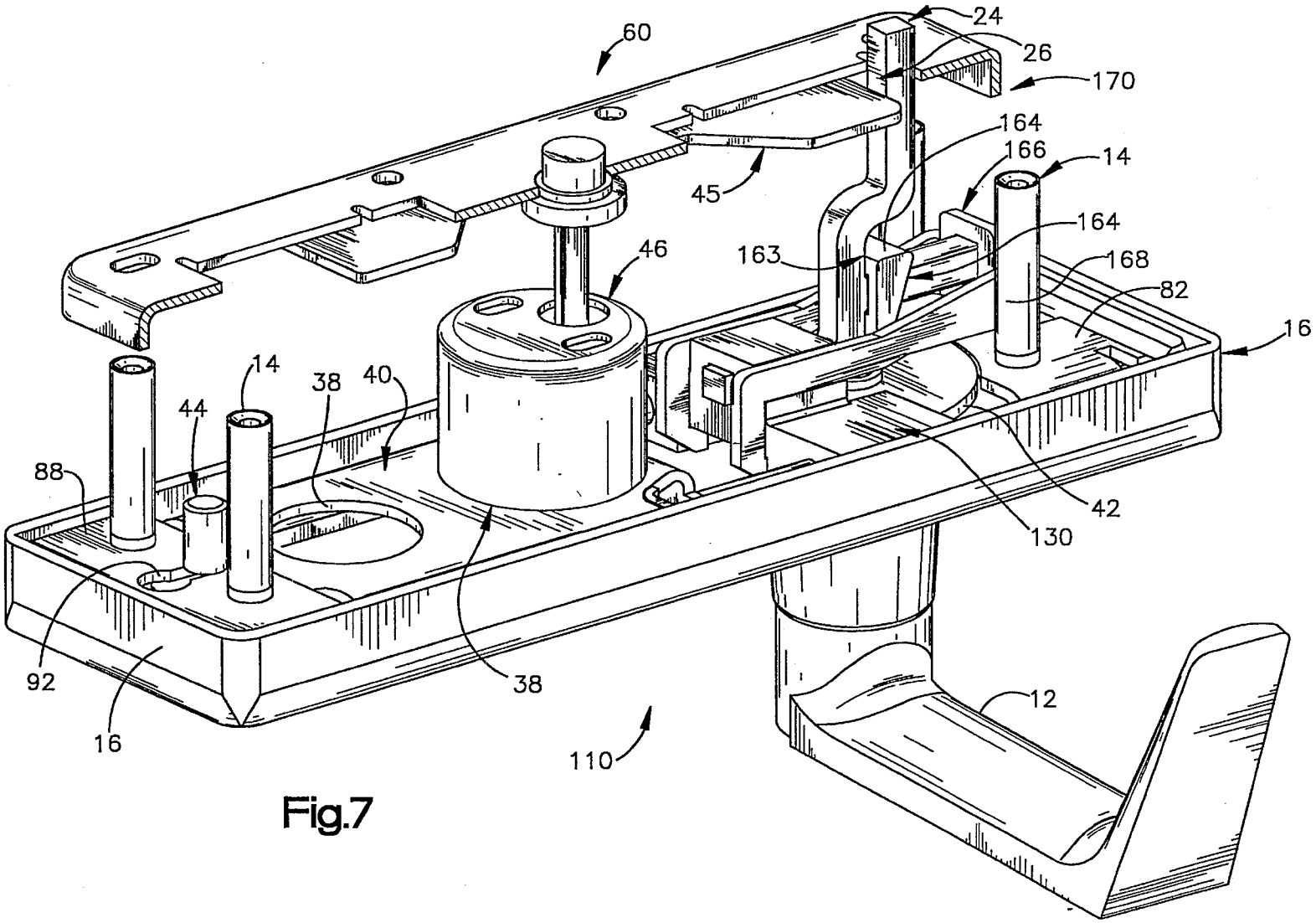
FIG. 7 is a perspective view of an alternative embodiment of a wedge surface controlled breakaway feature, showing a slider retaining bracket holding an angle block.

In contrast to the foregoing fixed components, the door lever assembly 10 includes a number of interconnected linearly movable or rotatable components. For example, when unlocked, turning a lever handle 12 of conventional design results in rotation of an eccentrically configured cam 42 having cam wings 43, which in turn linearly moves a slider 30 and its connected lift arm 24 to retract door latches 61. The lift arm 24 moves components of a door latch assembly 60 (See FIGS. 1 and 6), including connected vertical rods 62 that operate retraction or extension of door latches 61. The door lever assembly 10 controls the lock/unlocked position of the door latch assembly 60 using a conventional key cylinder 46 that extends through the trim housing 16 to engage a conventional blocking slide 45 of the door latch assembly 60. The blocking slide 45 is moved upward or downward by rotation of the key cylinder 46. When the blocking slide 45 is positioned in an unlocked, upward position (position not indicated in the Figures), linear movement upward of the lift arm 24 is not impeded. However, when the blocking slide 45 is positioned in a downward, locked position, linear movement of the lift arm 24 is impeded.

As those skilled in the art will appreciate, construction of the lift arm 24 can be varied to accommodate various embodiments of the invention. In one preferred embodiment illustrated in FIG. 1, the lift arm 24 is immovably attached to the slider 30, and will typically be constructed from a single integral piece of metal to have a flat lock engaging portion 26. The lock engaging portion 26 engages the blocking slide 45 of the door latch assembly 60 when the blocking slide 45 is positioned in its locked position.

The slider 30 is a generally flat plate constrained for movement along the guide rods 80, and in normal operation is vertically movable within the trim housing 16. Vertical movement of the slider is indirectly promoted by rotational movement of the eccentrically configured cam 42, which causes its integrally defined cam wing-43 to rotate counterclockwise, upwardly pushing the slider 30 toward stop plate 34, and in turn upwardly impelling the lift arm 24. Opposing upward movement of the slider 30 are dual lift springs 32 fitted over the guide rods 80 to lie between the slider 30 and stop plate 34. The lift springs 32 are biased to normally push the slider 3Q downward, away from the plate 40. This downward impulse acts to rotate the cam 42 clockwise, bringing the connected lever handle 12 back to its normal horizontally extending position.

Figure 3:
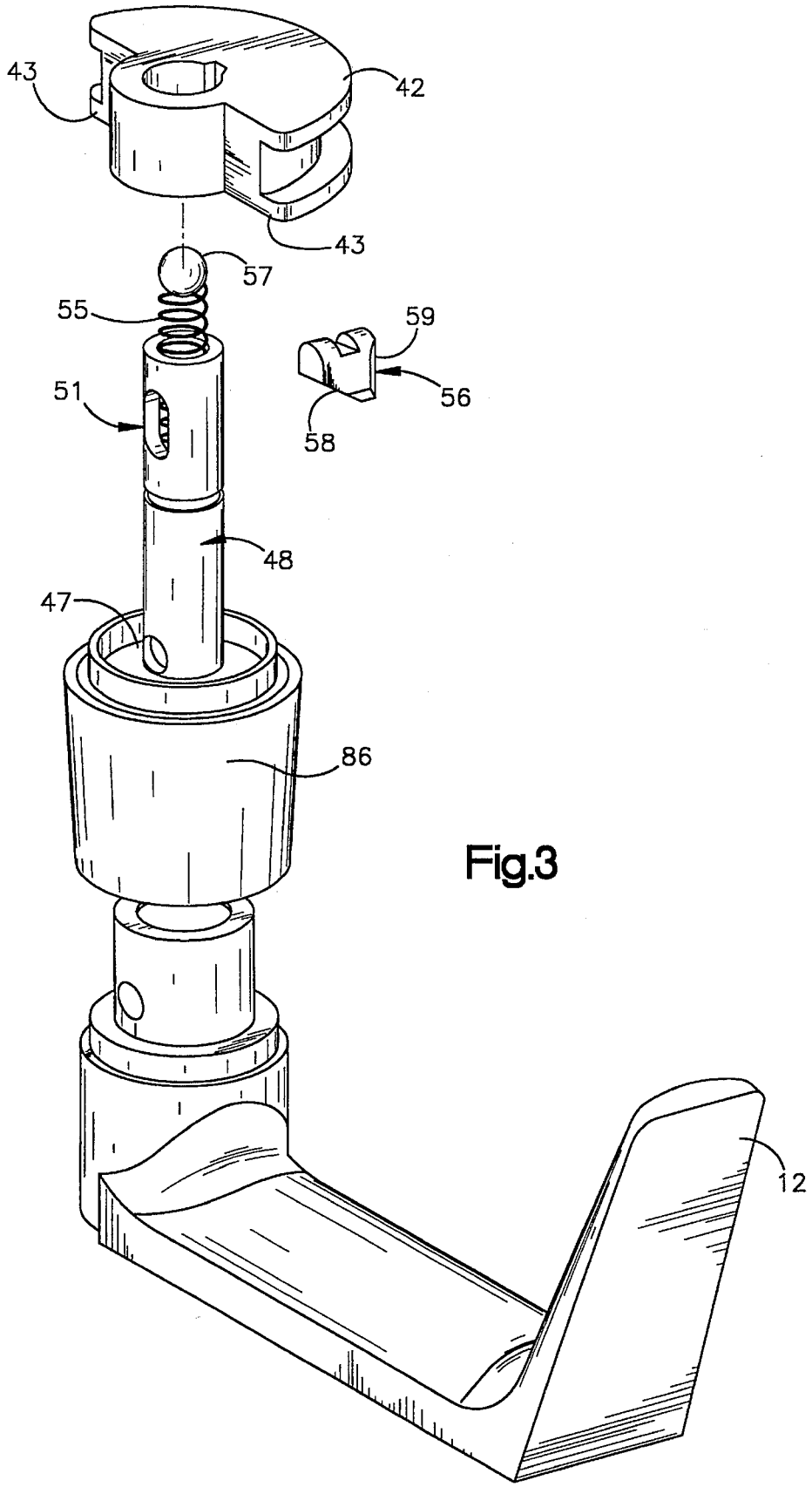
FIG. 3 is an exploded perspective view of a hollow shaft with its insertible wedge mechanism providing a breakaway connection between the cam and the door lever handle.
Figure 4:
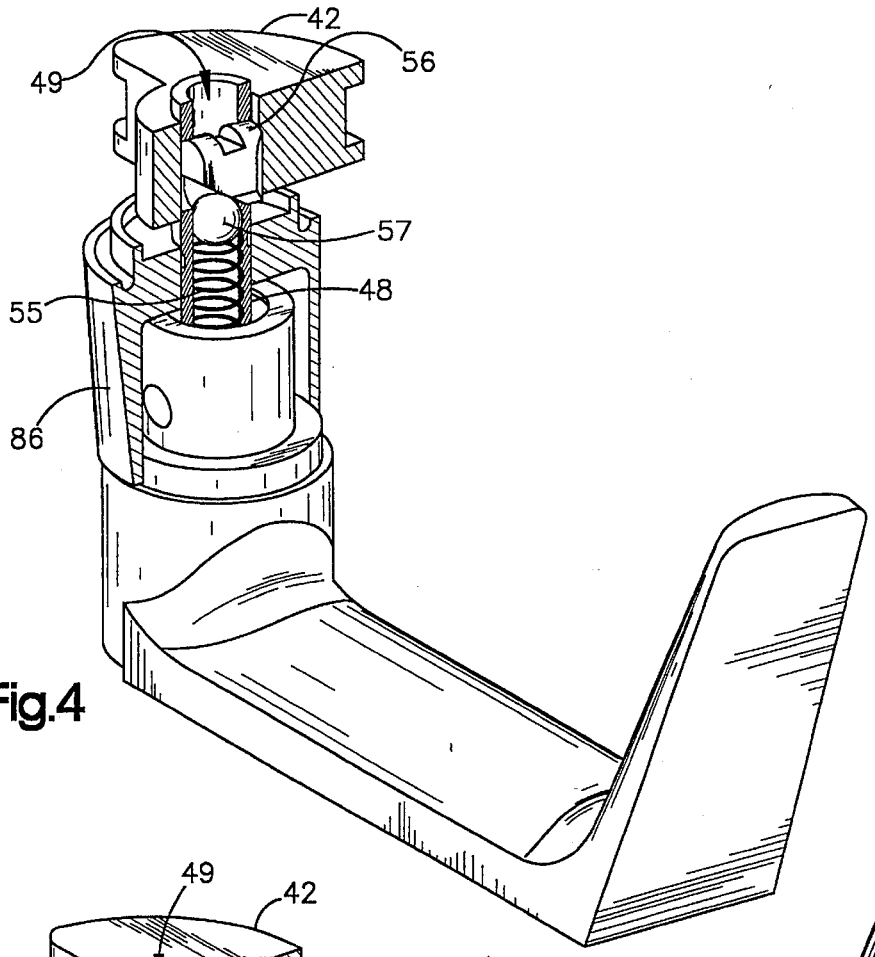
FIG. 4 is an broken away partial perspective view of the door lever assembly in an unlocked position, with a wedge protruding from a connection groove in the hollow shaft to engage the cam.

In normal operation, the cam 42 is rigidly coupled to rotate in response to rotation of the lever handle 12 by the combination of a shaft 48 and a wedge mechanism 70. The shaft 48 is of conventional construction, and defines a connection groove 51 therethrough to provide access to its shaft interior 49. As best seen in FIGS. 3 and 4, the wedge mechanism 70 has a reset spring 55 that supports a ball bearing 57. Floating in the shaft interior above the ball bearing 57 is a wedge pin 56. The wedge pin 56 is configured to define faces 58 and 59, and can partially extend from the shaft interior through the groove 51 to engage the cam 42.

Figure 5:
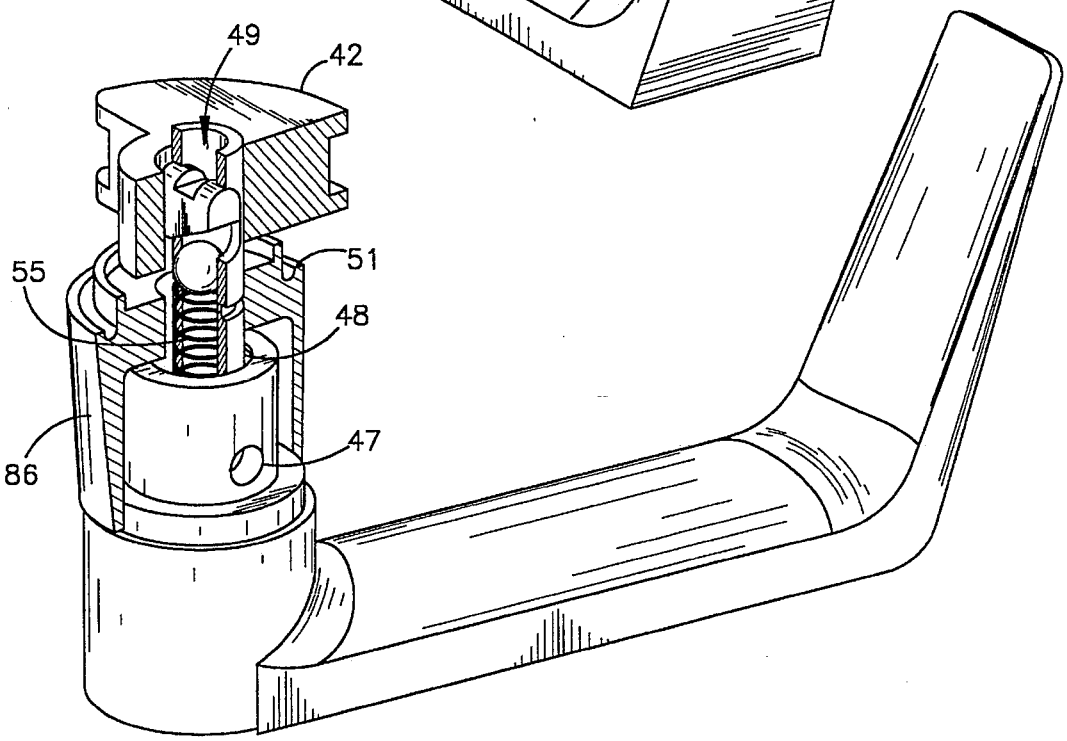
FIG. 5 is a broken away partial perspective view similar to that shown in FIG. 4, however the door lever assembly is locked, forcing the wedge into the hollow shaft and breaking the connection between the shaft and the cam.

The positioning of the wedge pin 56 is responsive to the amount of torque force applied to the shaft 48 by the lever handle 12. The force exerted by the combination of the spring 55 and ball bearing 57 against wedge face 58 is dynamically balanced against the wedging force applied by the cam against the wedge face 59 of the wedge pin 56. As best shown in FIG. 5, when the wedging force applied by the cam increases to a predetermined level (based on the exact wedge face angles and spring constant of spring 55), the wedge pin 56 is forced into shaft interior 49 of shaft 48, breaking the connection between the shaft and the cam.

Once the connection between the shaft and the cam is broken, the lever handle 12 is free-wheeling, and further application of force will not result in damage to the wedge mechanism, slider, cam or other components held within the trim housing 16. However, it only requires return of the lever handle 12 to its original position to reset the wedge mechanism 70, with the reset spring/ball bearing forcing the wedge pin 56 back into it reversible connection with cam 42.

Alternative embodiments of the present invention that also rely on wedge based mechanisms to break engagement between the lever handle and the lift arm when inappropriately high torque forces are exerted against the lift arm are also contemplated. For example, as shown in FIGS. 7–10, a door lever assembly 110 substantially similar in components and mode of operation to door lever assembly 10 can include an alternative slider 130 that supports an attached alternative wedge mechanism 170. In function, this alternative embodiment acts substantially similar to the foregoing embodiment of the present invention illustrated by FIGS. 1–6, however, the particular arrangement and action of wedge mechanism 170 for disengaging the cam 42 from the lever handle 12 is substantially different from that of wedge mechanism 70. In addition, the lift arm 24 is replaced by lift arm 124 that has a lift arm extension 165 extending perpendicular with respect to both a block engaging portion 163 and a lock engaging portion 126.

Figure 8:
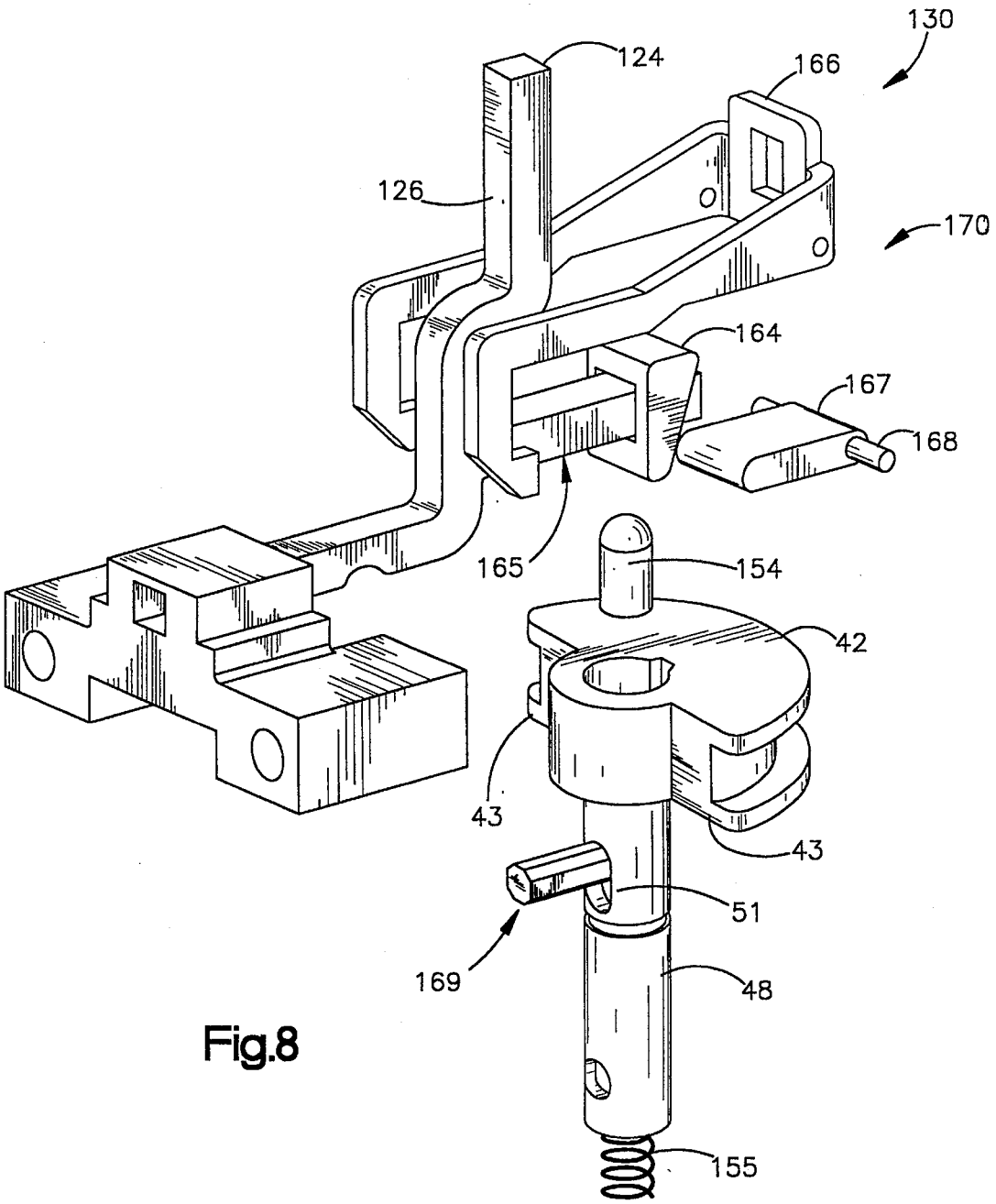
FIG. 8 is an exploded perspective view of the slider assembly shown in FIG. 7, showing the pivotally mounted blocking pivot, and the cam, plunger, and cam drive pin assembly.
Figure 10:
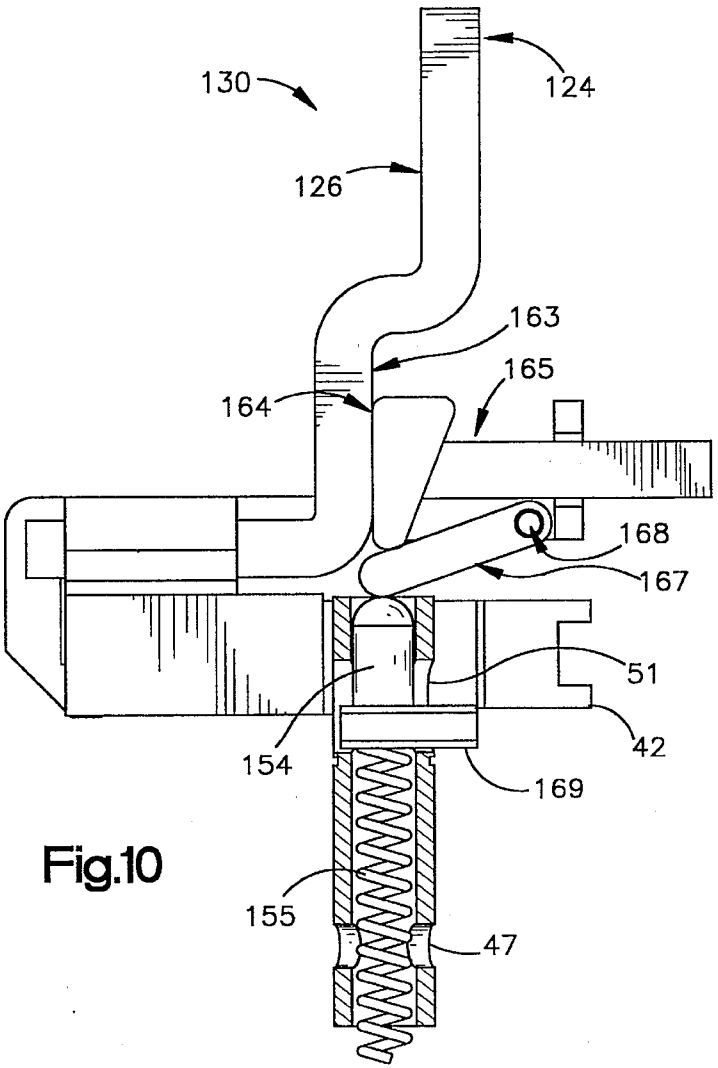
FIGS. 9 and 10 are side views of the assembled slider assembly of FIG. 8, partially broken away to better illustrate positioning of the reset spring, cam drive pin, and plunger, with FIG. 9 showing the initial position of the blocking pivot, and FIG. 10 showing the position of the blocking pivot after it has slipped down the angled, sloping surface of the angle block in response to excessive forces applied by the cam to the slider assembly.
Figure 9:
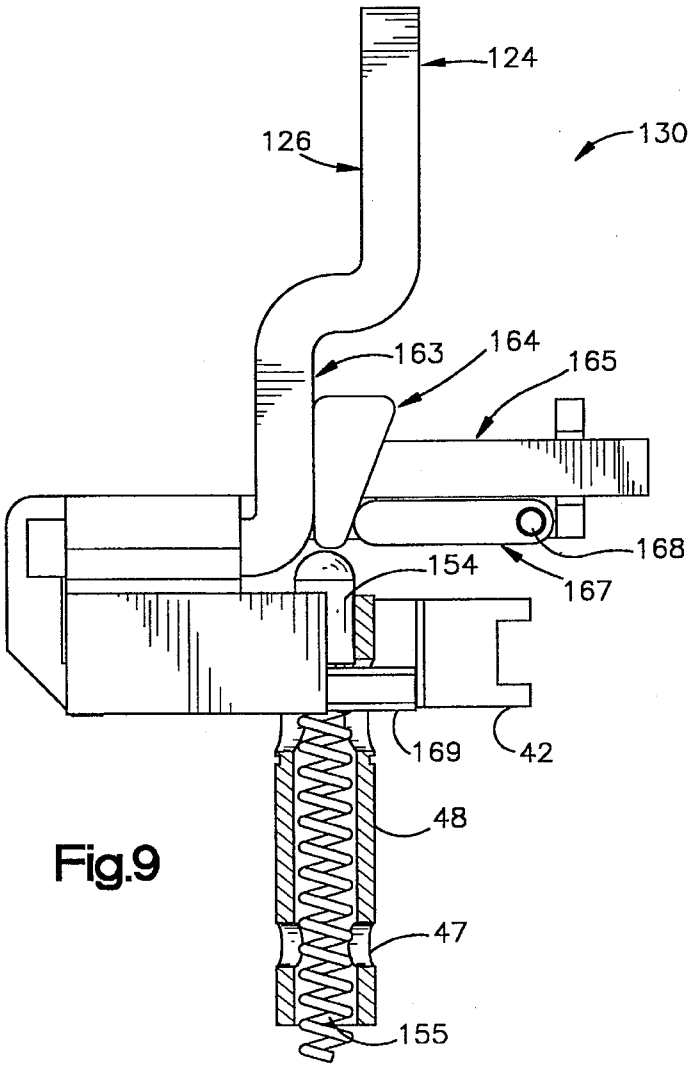

As best seen in the exploded perspective view of FIG. 8 and the side view of FIG. 9, the slider assembly 130 supports wedge mechanism 170 for breaking attachment between the slider assembly 130 and cam 42 when inappropriate torque forces are applied to the lever handle 12. The wedge mechanism 170 includes an angle block 164 fitted over the lift arm extension 165 to lie adjacent to the block engaging portion 163. In addition, a blocking pivot 167 having a projecting pin 168 is attached by pin 168 to a slider retaining bracket 166. As best seen in FIG. 9, the blocking pivot lies approximately perpendicular to the wedge shaped surface of the angle block 164. The exact angle of the angle block is adjusted so that a predetermined amount of torque force will allow the blocking pivot to slip from its frictional connection with the angle block.

In operation, the wedge mechanism 170 acts to break the connection between cam 42 and shaft 48 by forcing depression of a plunger 154 resting atop a cam drive pin 169. The cam drive pin 169 is fitted to normally extend from shaft interior 49 of shaft 48 to engage the cam 42. However, when excessive torque forces are applied to the door lever assembly 110 in its locked position with the lift arm 124 held by blocking slide 45, the slider assembly 130 begins to move toward the stop plate 134. As best seen by comparing FIGS. 9 and 10, this results in an increase in the force exerted by the blocking pivot 167 against the angle block 164. As the torque force is increased, eventually the blocking pivot 167 slips from its abutting connection to the angle block 164, dropping toward the plunger 154. The plunger 154 is driven downward into the shaft 48 against the force of reset spring 155, displacing the cam drive pin 169 and breaking the connection between the cam 42 and lever handle 12. Of course, like the earlier described embodiment, the wedge mechanism 170 can be reset to engage the lever handle 12 and cam 42 simply by rotating the lever handle 12 to return it to its initial position.

Figure 11:
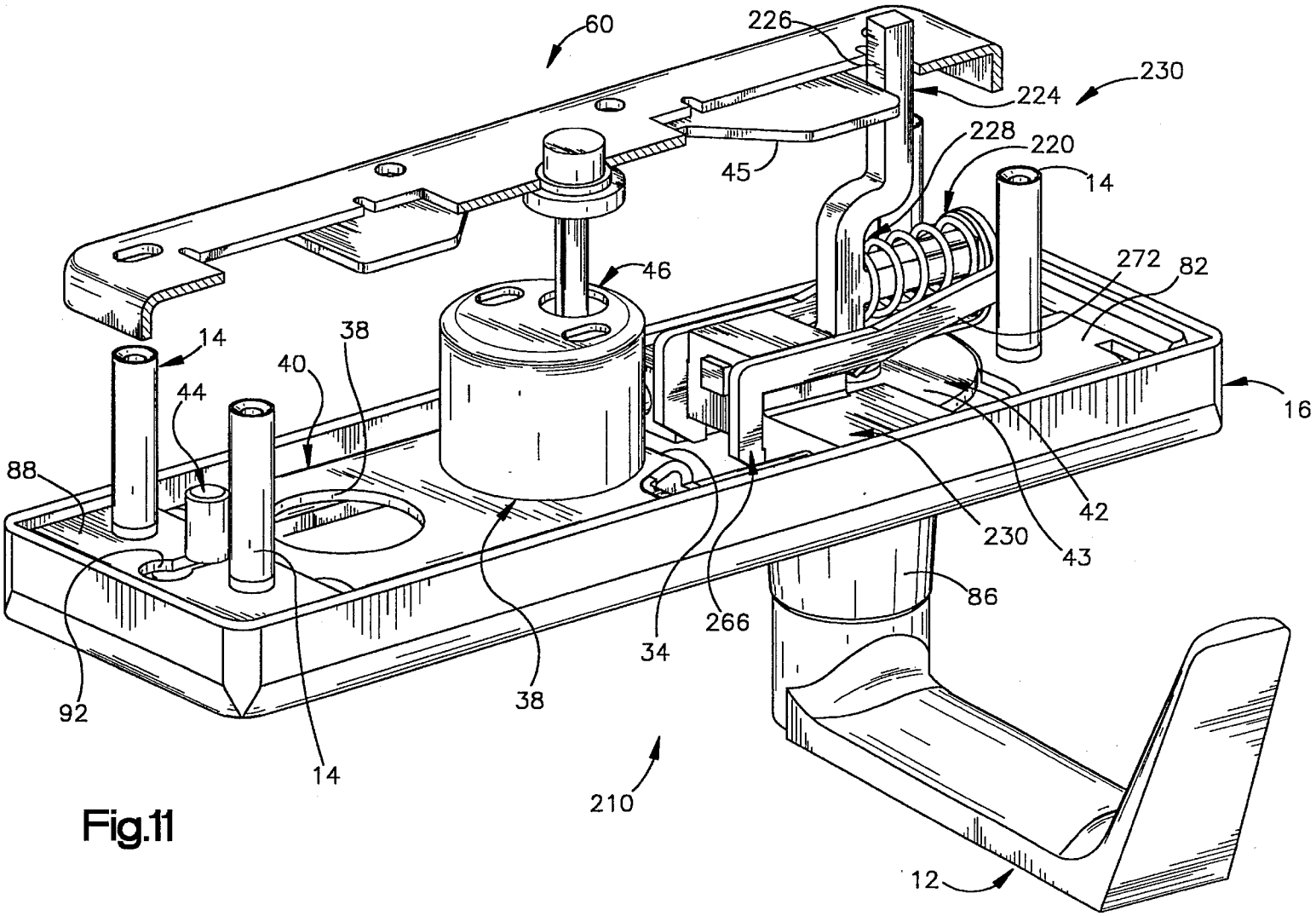
FIG. 11 is a perspective view of yet another alternative embodiment of a wedge surface controlled breakaway feature, with a slider assembly additionally supporting an over-ride spring for absorbing excessive force applied to the door lever handle.
Figure 12:
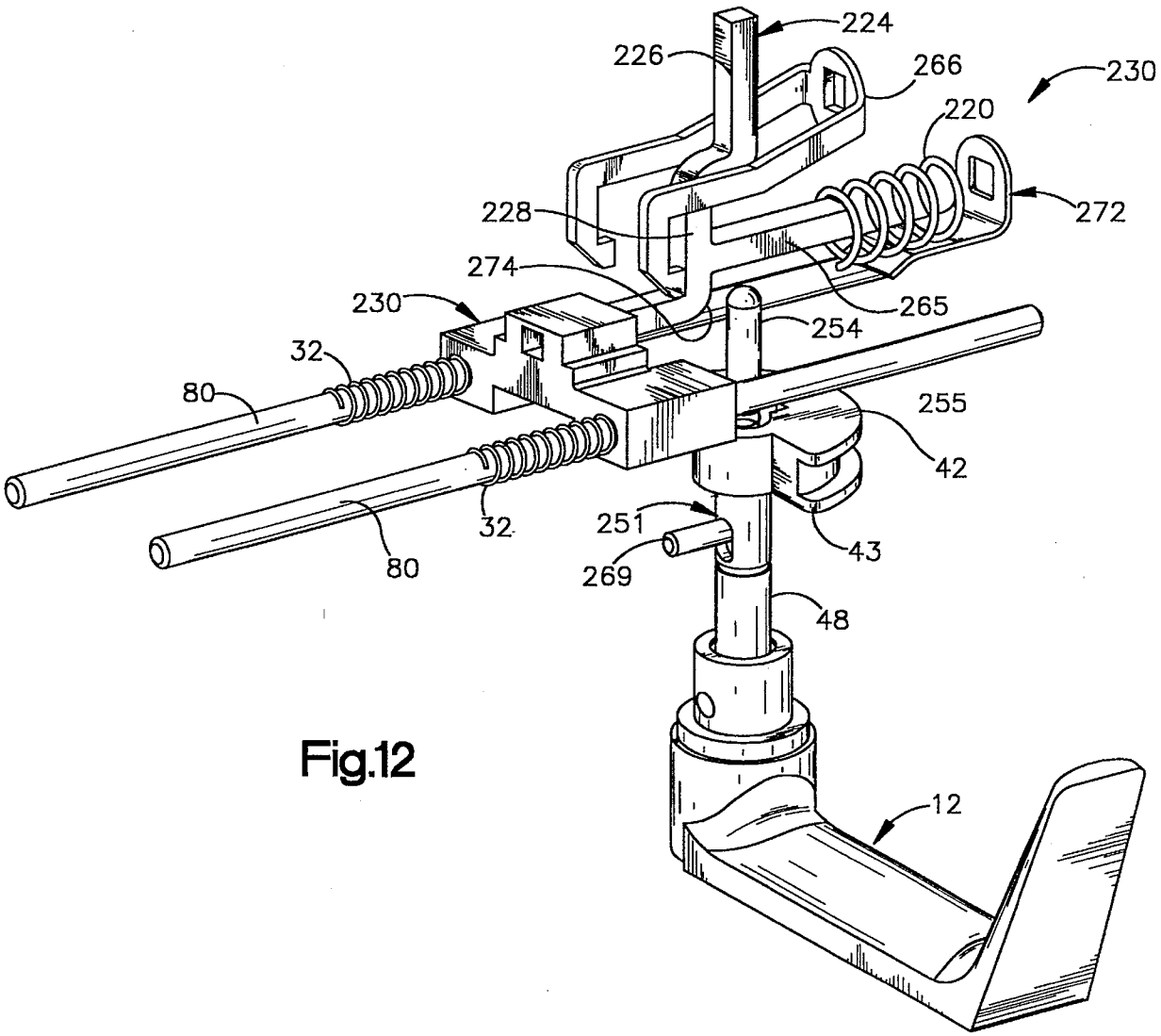
FIG. 12 is an exploded perspective view of the slider assembly, lift arm, and the cam/shaft/lever components of FIG. 11.

Yet another embodiment of the present invention providing an alternative apparatus for wedge assisted control of a cam drive pin is illustrated by FIGS. 11 through 14. As best illustrated in FIGS. 11 and 12, a door lever assembly 210 includes a slider assembly 230 that cooperates with other components substantially similar to that previously described in connection with FIGS. 1–10. The slider assembly 230 includes a permanently attached lift arm 224 that has a lock engaging portion 226, a spring engaging portion 228, a lift arm extension 265, and defines a lift arm wedge face 274 adjacent to the spring engaging portion 228. Both a spring wedge 272 and an over-ride spring 220 are held in position by the combination of the lift arm extension 265 and a retaining bracket 266.

Figure 14:
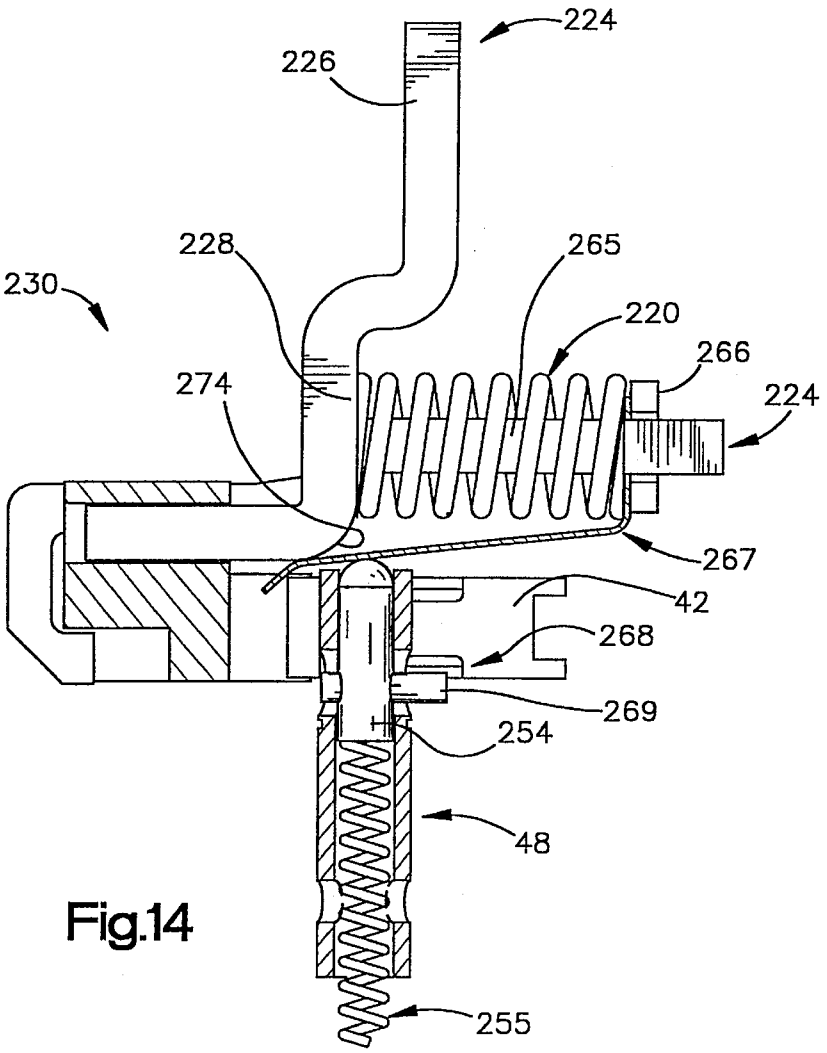
FIGS. 13 and 14 are side views of the assembled slider assembly of FIG. 12, partially broken away to better illustrate positioning of the reset spring, cam drive pin, and plunger, with FIG. 13 showing the initial position of a spring wedge, and FIG. 14 showing the position of the spring wedge after it has slipped down the angled, sloping surface of the lift arm wedge face of the lift arm to depress a plunger and disconnect the cam and the shaft in response to excessive forces applied by the cam to the slider assembly.
Figure 13:
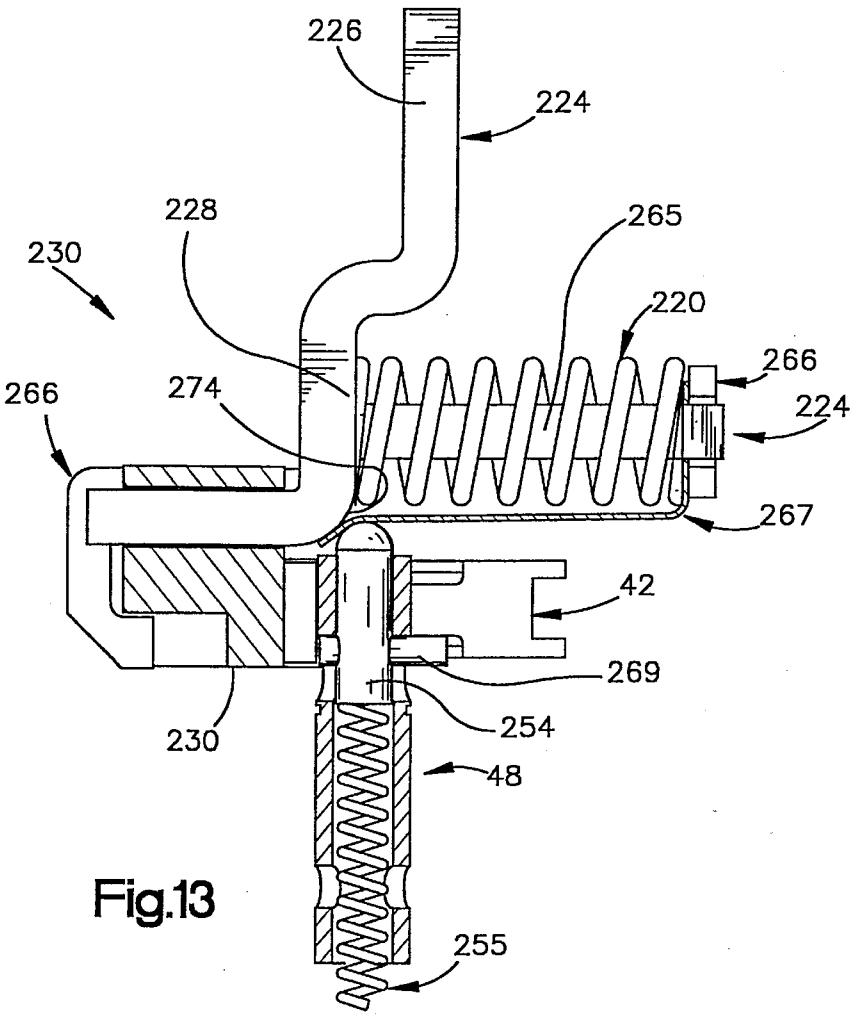

FIGS. 13 and 14 illustrate the slider assembly 230 of the door lever assembly 210 in a locked position with movement of the lift arm 224 inhibited by a blocking slide 45 (shown in FIG. 11). Starting from the initial position of FIG. 13, the cam 42 is rotated to apply force to the slider assembly 230. Since the lift arm 224 is held in position, the lift arm 224 begins to compress the over-ride spring 220. Simultaneously, the wedge spring 272 advances over the lift arm wedge face 274 driving the wedge spring 272 toward a plunger 254. As the plunger 254 is depressed against the resistance of a reset spring 255, an attached cam drive pin 269 is moved along the connection groove 251 defined in the shaft 48. Eventually, when the over-ride spring 220 is sufficiently compressed, the cam drive pin 269 will be forced out of its driving connection with the cam 42. At this point, the lever handle 12 and attached shaft 48 are no longer connected to the cam 42 or other components linking the cam to the door latch assembly. However, simply returning the door lever handle 12 to its initial position will reset the cam drive pin 269, which is forced back into position by the reset spring 255.

Advantageously, this embodiment of the invention allows the normal operation and use of a door lever assembly that is substantially identical to conventional door lever assemblies when normal forces are exerted and the door is unlocked. The over-ride spring 220 is configured to have a high spring constant and a substantial preload of approximately 70 pounds, making it essentially incompressible when the door is unlocked. Turning the door lever handle 12 causes rotation of the attached shaft 48, which in turn rotates the cam. Rotation of the cam moves the slider assembly 230 as a one piece unit, causing the lift arm 224 to engage and unlatch the door latch assembly.

However, when excessive forces are exerted against the door lever handle, such as applied in attempts to force a door lever assembly or vandalize it, when in a locked position the slider assembly 230 does not move as a single unit, but instead moves as previously described, with lift arm movement relative to the rest of the slider assembly 230 wedging downward the wedge spring to break the connection between the shaft 48 and the cam 42. The over-ride spring 220 absorbs a predetermined level of force, and if that level is exceeded the linkage between the door lever handle and the door latch assembly is temporarily broken. Advantageously, all disclosed embodiments of the present invention allow the normal operation and use of a door lever assembly that is substantially identical to conventional door lever assemblies when normal forces are exerted. However, when excessive forces are exerted against the door lever handle, such as applied in attempts to force a door lock or vandalize, in a locked position the present mechanism disengages the lever from the cam by retraction of the shear pin into the shaft to prevent damage to the door lever assembly. There will be typically no need to rely on shear pin failure to prevent damage to the locked door lever assembly.

While the present invention has been described in connection with specific embodiments, it will be apparent to those skilled in the art that various changes may be made therein without departing from the spirit or scope of the invention.

What is claimed is:

1. A door lever assembly having a locked and an unlocked position for controlling a door latch assembly, the door lever assembly comprising:

a trim housing and a stop plate projecting therefrom;

a lever handle rotatably connected to the trim housing;

a cam configured for rotation;

a shaft extending between the lever handle and the cam, the shaft defining a connection groove therethrough to provide access to a shaft interior, with a cam drive pin projecting from the shaft interior for connecting the cam and the shaft and a plunger positioned adjacent to the cam drive pin to extend from the shaft interior;

A slider assembly engaged to move in response to cam rotation, the slider assembly having an angle block and a pivotally mounted blocking pivot, with the blocking pivot frictionally engaged with the angle block until abnormally high force applied by the cam causes the blocking pivot to slip from its connection with the angle block to depress the plunger and its connected cam drive pin, breaking connection between the shaft and the cam; and a compressible lift spring positioned between the stop plate and the slider assembly for compression as the slider assembly moves toward the stop plate and expansion away from the stop plate to return the lever handle to an initial position upon release of the lever handle.

2. The door lever assembly of claim 1, further comprising a lift arm attached to the slider assembly, the lift arm moving to engage and disengage latches of the door latch assembly.

3. The door lever assembly of claim 1, further comprises a reset spring positioned in the shaft interior to urge the plunger and cam drive pin toward the cam to reconnect the cam and the shaft.

4. The door lever assembly of claim 2, wherein the angle block is supported by a lift arm extension projecting from the lift arm, and a blocking pivot is pivotally mounted to a slider assembly retaining bracket configured to surround the lift arm extension.

5. A door lever assembly having a locked and an unlocked position for controlling a door latch assembly, the door lever assembly comprising:

a trim housing having a stop plate projecting therefrom;

a lever handle rotatably connected to the trim housing;

a cam configured for rotation;

a shaft extending between the lever handle and the cam, the shaft defining a connection groove therethrough to provide access to a shaft interior, with a cam drive pin projecting from the shaft interior for connecting the cam and the shaft and a plunger positioned adjacent to the cam drive pin to to extend from the shaft interior;

A slider assembly engaged to move in response to cam rotation, the slider assembly having an over-ride spring, a spring wedge, and a lift arm having a lift arm wedge face for engaging the spring wedge, the lift arm being configured to engage the door latch assembly, and wherein abnormally high force applied by the cam to the slider assembly in its locked position compresses the over-ride spring and moves the spring wedge over the lift arm wedge face to inwardly force the spring wedge toward the cam, depressing the plunger and its connected cam drive pin to break the connection between the shaft and the cam; and a compressible lift spring positioned between the stop plate and the slider assembly for compression as the slider assembly moves toward the stop plate and expansion away from the stop plate to return the lever handle to an initial position upon release of the lever handle.

6. The door lever assembly of claim 5, further comprising a reset spring positioned in the shaft interior to urge the plunger and cam drive pin toward the cam to reconnect the cam and the shaft.

7. The door lever assembly of claim 5, wherein the wedge spring is supported by a lift arm extension projecting from the lift arm, and the over-ride spring is held in position by a slider assembly retaining bracket configured to surround the lift arm extension.

* * * * *